United States Patent [19]

Long et al.

[11] 4,151,805

[45] May 1, 1979

[54] TUFTING METHOD AND APPARATUS FOR ELIMINATING STOP MARKS IN CARPETS

[75] Inventors: Coy F. Long, Sugar Valley; Robert F. Edwards, Chatsworth; Leslie R. Reeves; William S. Reeves, both of Calhoun, all of Ga.

[73] Assignee: Wellco Carpet Corporation, Calhoun, Ga.

[21] Appl. No.: 809,414

[22] Filed: Jun. 23, 1977

[51] Int. Cl.[2] ..... D05C 15/12; D05B 69/22

[52] U.S. Cl. ..... 112/79 R; 112/275; 112/266.2

[58] Field of Search ..... 112/275, 277, 79 R, 112/214, 79 A, 220, 221, 266

[56] References Cited

U.S. PATENT DOCUMENTS

| | | | |
|---|---|---|---|
| 3,529,560 | 9/1970 | Jackson | 112/275 X |
| 3,548,766 | 12/1970 | Colbert | 112/79 R |
| 3,762,346 | 10/1973 | Cobble | 112/79 R |

*Primary Examiner*—Peter Nerbun

*Attorney, Agent, or Firm*—Cushman, Darby & Cushman

[57] ABSTRACT

Method and apparatus for eliminating the formation of stop marks during the tufting of carpets by stopping the needle bar at substantially the same position each time the machine is stopped by varying start-up procedures in order to remove any looseness in the yarn feed system and for providing an initial overfed supply of yarn and employing means for providing a soft start for the main tufting machine drive motor. By restarting the tufting machine in a slow, even manner and by having the starting of the yarn feed system precede the restarting of the main drive motor for the tufting machine yarn feed can be controlled thereby producing in phase, synchronized start-ups which do not cause a loss of pile height in the last tufted row or rows of pile loops.

16 Claims, 7 Drawing Figures

10
60
66
16
30
F
28
29
80
82
83
84
100
86
98
94
96
102
104
106
108
12
89
90
88
92
27d
114
27c
27a
27b
110
118
116
26
112
27
128
124
122
120
126

TUFTING METHOD AND APPARATUS FOR ELIMINATING STOP MARKS IN CARPETS

BACKGROUND OF THE INVENTION

The present invention relates to novel apparatus and an improved method for both stopping and restarting a tufting machine during its operation whereby the production of stop marks in the pile fabric may be substantially eliminated.

As is well-known in the carpet industry, a defect which often occurs during the production of tufted carpet when tufting machines are stopped or restarted is known as a stop mark or tufting streak. Stop marks are visible defects which appear on the face or pile side of a tufted carpet and generally extend across the entire width thereof. Normally, the tuft loops forming the face or pile side of the carpet have a predetermined pile height, with the pile height in plush type carpets being uniform while the pile height in sculptured carpets usually varies between two different pile heights. A stop mark, however, results when the row or rows of tuft loops closest the needles has some of the yarn pulled therefrom so that the height of the yarn therein is other than what it should be.

Over the years stop marks have been found to have resulted from a variety of causes. For example, as indicated in U.S. Pat. No. 3,762,346, if the yarn used in tufting carpets is held under tension for a long enough period while the machine is stopped, stop marks can result.

While operators normally attempt to stop tufting machines such that the needles are in their fully raised position above the backing fabric, holding the needles in such a position causes tension to be placed on the pile yarn since the thread jerk mechanism is exerting maximum tension on the yarn when the needles are raised. As suggested in this patent, prolonged tension sometimes causes elongation of the yarns and eventually a drawing out of the loops previously formed thereby producing a line of tufting loops across the face of the carpet which have a reduced pile height known as a stop mark which is quite clearly visible. In the above patent it was suggested that stop marks attributable to yarn tension could be eliminated by providing a yarn tension control mechanism so that when the needle bar was stopped tension commonly applied to the yarn was relaxed so that the tufting machine could be stopped for relatively long periods of time without causing elongation of the yarn.

Another attempt at overcoming stop mark problems is disclosed in U.S. Pat. No. 3,548,766. In this device, when the tufting machine was stopped, one set of rolls used to feed yarn to the tufting machine was continuously rotated in its yarn feed direction by an auxiliary drive but the roll pressure on the yarn was relaxed so that rather than be applying a full driving force the rolls were allowed to slip on the yarn. Thus, without actually continuing to feed yarns, the yarns were maintained under a positive tension and a retraction of the yarn from the puller rolls in a direction counter to that of the feed direction was prevented. In this way, the yarn was prevented from being pulled from the last row of tufted loops with the hope that stop marks would be prevented when the machine again began the tufting process.

Two other attempts to effectively eliminate stop marks dealt with the feeding of backing fabric through the tufting machine. In U.S. Pat. Nos. 2,840,019 and 2,857,867 the backing fabric was tensioned within predetermined limits and worm gears were used to effectively lock the backing fabric drive train so as to prevent any reverse movement of the backing fabric through the machine upon a start-up after the tufting machine had once been stopped. In effect, an attempt was made to limit the amount of backlash in the gear train feeding the backing fabric. As brought out in 2,840,019, the use of a slip clutch functions, in effect, to apply a sufficient positive load to the feed roll shafts which aided in eliminating the backlash in the backing fabric gear train and at the same time maintained a light tension on the fabric in the area between the feed rolls and the needle bar.

BRIEF DESCRIPTION OF THE PRESENT INVENTION

In the tufting process, yarn is initially pulled from a creel or other suitable supply such as beams or yarn packages, and thereafter is passed through a series of guides and eventually through the eyes of the tufting needles. Backing fabric is continuously fed beneath the needles over a needle bed and looper hooks are oscillated in a timed relationship with the stroke of the needles for the purpose of catching and holding loops formed by the needles as they penetrate the backing material. The operation of the needles, hooks and backing feed mechanisms are all synchronized in a manner such that the operation of identical rows of tufts are produced on each stroke of the needles. Therefore, if one or more of the rows differ in height from any of the adjacent rows, or from a predetermined multilevel pattern, a line or band is formed which is quite visible across the width of the carpet. As indicated above, stop marks often occur upon stopping and/or the subsequent restarting of the machine.

The height of each row of tuft loops is determined by the length of the needle stroke through the backing material, the yarn feed rate, and the effect of the yarn feed rate or pull back effected on each row of tufted loops. In production, different pile heights can be obtained by adjustments to the yarn feed rate while employing a fixed needle stroke. Thus, with a given needle stroke distance, as yarn feed is varied the amount of yarn available for tufting will likewise vary thereby producing different tufting loop or pile heights as pull back increases or decreases. For example assuming a fixed needle stroke, as yarn feed is increased, the amount of pull back is decreased thereby producing higher tufted loops. Conversely, if the amount of yarn available for use is decreased, the amount of pull back will increase resulting in lower tufted loops. However, while running for a given yarn height, or loop height, the needle stroke and yarn feed rate together with the amount of pull back should be equal on each stroke so that the rows of tuft loops being formed will exhibit an equal height.

We have discovered that after stopping tufting machines notwithstanding that there may not have been tension on the yarn during the period the machine was stopped or that there was not sufficient tension placed on the backing fabric being fed through the machine, a row or rows of tufts can be produced upon start-up with which an additional amount of pull back has been associated which is different from the amount of pull back occurring while the machine is operating thereby producing stop marks. In fact, we have found that another cause of stop marks is due to unequal start-up rates for the needle bar or the main drive for the tufting machine and the yarn feed system. As the tufting machine is started after being stopped, the main drive motor, which rotates the main drive shaft, is connected to the needle bar by a crank mechanism connected to that main drive shaft so that any angular displacement of the main drive shaft produces a proportional and direct angular displacement for the needle bar. Thus, there is almost no backlash or loose motion in that main portion of the tufting machine drive system. The yarn feed system, part of which comprises yarn feed rolls, however, are driven by the main drive motor and drive shaft, but usually through a series of belts, gears and chains. Therefore, even though the main drive motor drives the yarn feed system, it is quite possible that a considerably amount of backlash or loose motion can be involved. Such loose motion in the yarn feed system will affect the timing of placing the yarn feed rolls back into operation such that upon restarting the machine, the main drive shaft and needle bar will be in motion before the yarn feed system, specifically the yarn feed rolls, have begun to feed yarn so that even if there is slack yarn in the yarn feed system, that slack is taken up before a normal yarn feed is reestablished.

Thus, the initiation of the needle stroke to a normal operating speed prior to rotation of the yarn feed rolls will produce excessive pull back resulting in the formation of stop marks notwithstanding that the yarn may not have been under tension during the stop condition or that the feeding of backing fabric is under control. Several rows can be produced prior to the time when the main drive shaft and yarn feed both attain full operating speed and are synchronized.

The present invention intends to eliminate any disparity in feed rates upon restarting that may initially exist between the main drive portions of the tufting machine and the yarn feed system driven thereby. The method of restarting involves a combination of steps which together assure that the main drive and needle bar which require yarn to be fed at a predetermined rate to come into operation substantially simultaneously together with the restarting of the yarn feed system.

Toward that end, it is important when stopping the tufting machine that the needles be stopped at their uppermost position by stopping the main drive at an angular position within a predetermined range of angular positions each time. In order to accomplish this precise stopping extremely large brakes are used so that when the main drive shaft has slowed to a predetermined rate, that drive shaft can be stopped very quickly within that range of predetermined angular positions.

When it is desired to restart the machine, the yarn feed rolls are initially rotated a predetermined amount by an auxiliary drive means prior to the restarting of the main drive motor so as to not only provide a sufficient quantity of yarn in an essentially overfed condition sufficient to produce a first number of rows of tufts but also simultaneously removes any possible slack or looseness within the yarn feed system gearing or drive elements essentially bringing it into substantially a direct linkage relationship with the main driving elements of the tufting machine as is the needle bar. When restarting the main drive motor and main drive shaft, a fluid clutch is used in conjunction with the main drive motor which allows the main driving elements in the tufting machine to start in a slow, smooth fashion. This relatively slow, even start assures that both the main driving elements, specifically the backing feed and needle bar will be brought up to a full speed condition in a proportional fashion together with the yarn feed system.

Therefore, the primary object of the present invention is to overcome stop mark problems associated with the stopping and subsequent restarting of tufting machines. Another object of the present invention is to overcome stop mark problems by providing an adjustable means for bringing the yarn feed system into a direct drive relationship with the main driving elements of the tufting machine and to thereafter bring both drive systems up to operating speed in a smooth fashion. A further object of the present invention is to control the stopping of the tufting machine each time at an angular position within a predetermined range of angular positions so that the amount of initial rotation for the yarn feed rollers can be correctly and precisely controlled when restarting without having to correct for widely varying angular starting positions of the main driving elements.

These and other objects will be more fully and completely understood and other significant features and advantages of the present invention will become more apparent during the following detailed description in view of the following drawings in which.

Figure 1:
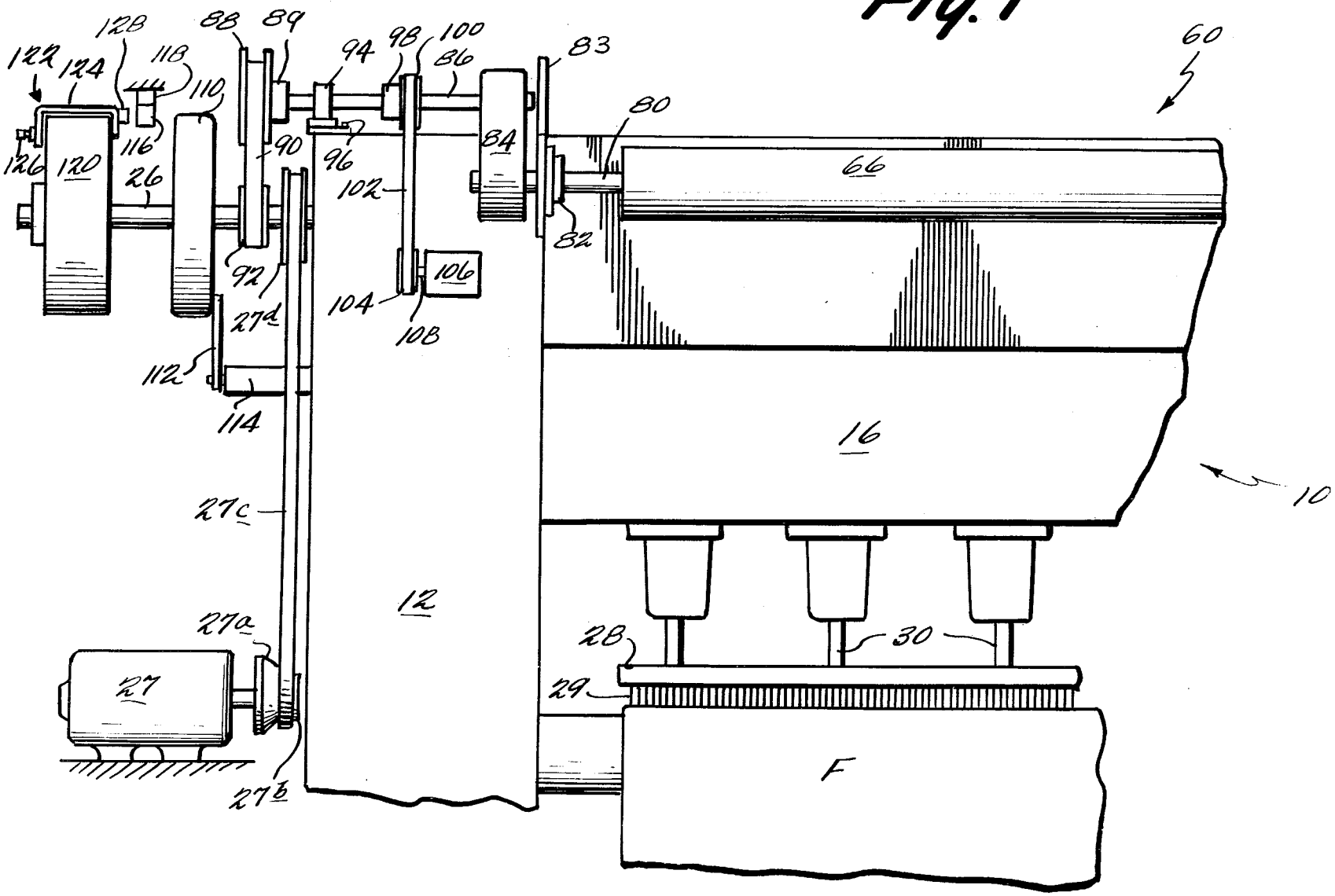
FIG. 1 is a partial front elevation showing the modified drive system for a tufting machine according to the present invention.
Figure 2:
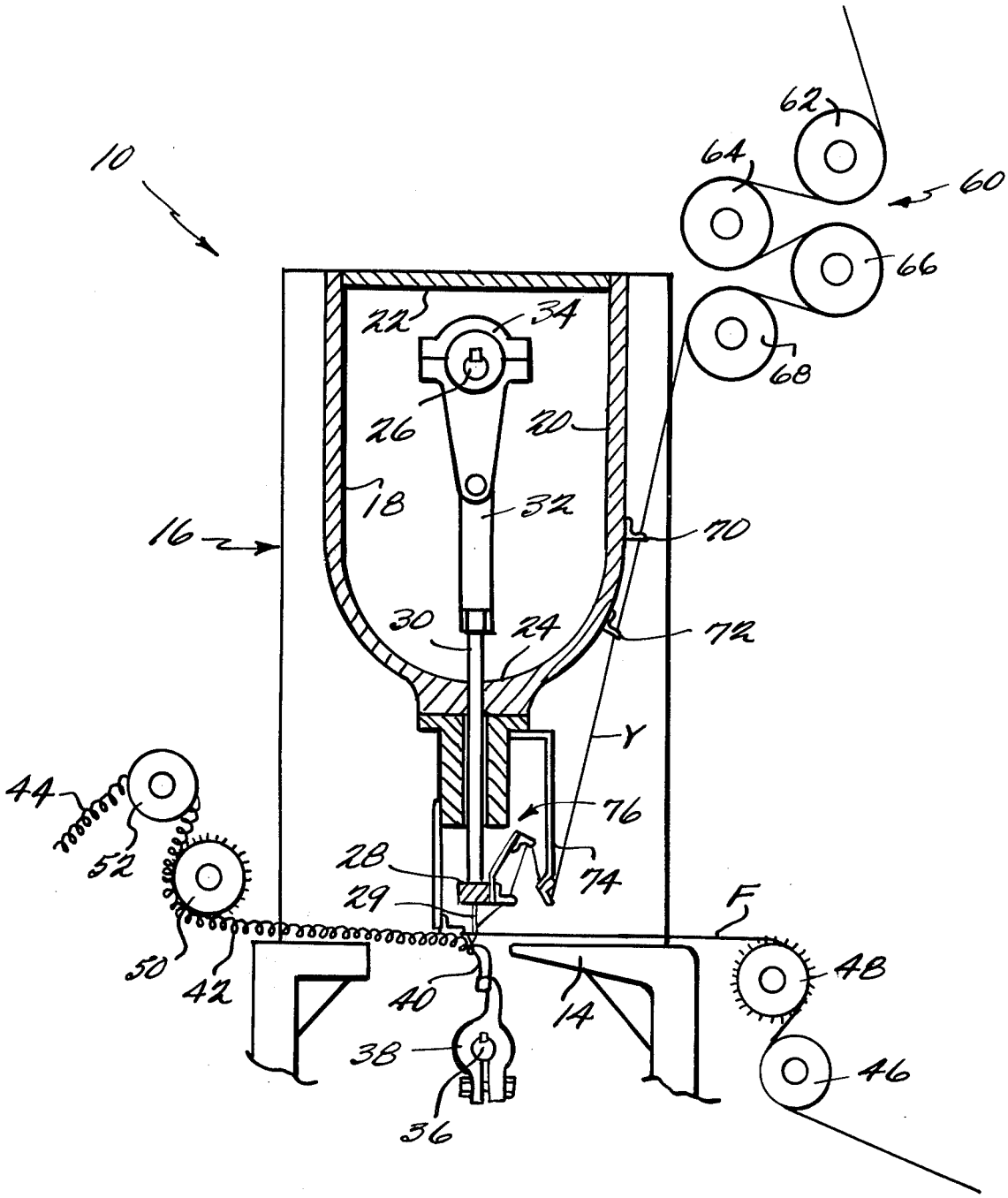
FIG. 2 is a vertical cross-sectional view through the tufting machine shown in FIG. 1.

Turning first to FIGS. 1 and 2, a tufting machine is shown generally at 10 as being comprised of a main frame 12 supporting a bed plate 14, a head casing 16, with head casing 16 being comprised of sidewalls 18 and 20, a top wall 22 and a bottom wall 24.

The main drive shaft for the tufting machine 26 extends horizontally through the head casing 16 being journaled in each end thereof in a conventional fashion, and may likewise be supported throughout its length by other suitable spaced bearings (not shown). It is adapted to be continuously driven by a main drive motor 27 through a fluid clutch **27*a* drivingly attached to a pulley 27*b*, pulley 27*d* mounted on main drive shaft 26 and drive belt 27*c***.

The needle bar 28 is directly connected to the main drive shaft 26 by means of a push rod 30, a linkage structure 32 and an eccentric 34 such that the rotation of main drive shaft 26 causes movement of eccentric 34 which in turn drives needle bar 28 in a vertical fashion.

The tufting machine 10 also has a looper shaft 36 which is directly driven by the main drive motor 27 through internal gearing (not shown) located within the tufting machine. Looper shaft 36 has attached thereto a looper head 38 provided with a plurality of loopers 40 which extend from the looper head toward the path of the tufting needles 29. The loopers 40 are operatively associated with and are moved in phase with needle bar 28 and needles 29 for forming successive rows of tufted loops in the backing fabric F from yarns Y. Thus, as an oscillating motion is provided to the looper shaft 36, loopers 40 are oscillated into and out of a cooperating relationship with needles 29 to produce the pile loops 42 on the carpet 44 as the backing fabric F is fed through the machine by backing fabric feed rolls 46, 48, 50 and 52. One type of backing feed system is disclosed in U.S. Pat. No. 2,857,867. Since the formation of pile loops in this manner is well-known in the art, further detailed description is, therefore, not deemed to be essential.

The yarn Y is fed by a yarn feeding system, generally indicated at 60, which, as shown in FIG. 2, is comprised of yarn feed rolls 62, 64, 66 and 68. After the yarn leaves feed roll 68 it passes through a series of guides 70, 72 and 74 through a conventional jerker assembly, generally indicated at 76, and then to and through needles 29.

In FIG. 1, only one yarn feed roller 66 is shown for purposes of clarity it being assumed that yarn feed rolls 62, 64 and 68 are mounted in a similar fashion. Yarn feed roller 66 is mounted on a shaft 80 with each end being suitably mounted within a bearing block 82 mounted on a mounting plate 83 which is welded or otherwise secured to the main frame 12. The shaft 80 passes through bearing 82 and mounting plate 83 and is the output shaft from a double reduction gear box 84, which for example can be a Dodge TD-2, 15:1 ratio gear box or a Boston Optimount 239-D, 14:45 ratio gear box. Gear box 84 serves to drive one of the four yarn feed rollers 62-68 such as 66 with the driven feed roller being suitably geared to the remaining yarn feed rollers so that the latter are driven thereby. A variation of this technique would involve a dual yarn feed roll drive system in which two yarn feed drives, one on each end of the tufting machine, are used. Each would, in all respects, be substantially identical to the one shown and described herein except that each would drive a pair of yarn feed rollers. It should be understood, however, that other alternative drive arrangements for feed rollers 62-64 would equally as well be employed.

Connected to the double reduction gear box 84 as the input shaft therefor is a yarn feed drive shaft 86 which is itself connected to a variable pitch pulley 88 through overrunning clutch 89. The variable pitch pulley 88 is connected by means of a drive belt 90 to a pulley 92 secured to the main drive shaft 26 by means of a key and keyslot (not shown) or any other convenient means. The yarn feed drive shaft 86 is mounted to the main frame 12 by means of a pillow block 94 itself being secured to frame 12 so that drive shaft 86 serves to support gear box 84 together with shaft 80. Connected between pillow block 94 and the gear box 84 is an overrunning clutch 98 which is drivingly connected to pulley 100. Pulley 100 is connected by means of a drive belt 102 to pulley 104 which is connected to auxiliary motor 106 through drive shaft 108 of motor 106.

Auxiliary motor 106 is provided for the purpose of initially moving the yarn feed drive elements to remove any looseness therein by turning the yarn feed drive shaft 86. Motor 106 can be for example a Honeywell M 945-A having an external rheostat Honeywell S 963-A so that the amount of driving output can be varied. Motor 106 will seldom have to turn shaft 86 more than one half of a complete revolution or 180° and the above exemplary motor is controllable through 160° of rotation. The overrunning clutches 89 and 98 can, for example, be a Formsprag FSR-10 type of clutch.

Also connected to each end of the main drive shaft 26 are shaft mounted electric brakes 110. Shaft mounted brakes 110 are held in position by means of a torque arm 112 one end of which is bolted or otherwise secured to the outer casing of brake 110 the other end being bolted or otherwise attached to a support arm 114. Support arm 114 is itself welded to main frame 12 and acts with torque arm 112 to restrain any movement of brakes 110 when the brakes are actuated. Exemplary of the type of electric brakes which can be used is a Warner EB-1225.

A proximity detector or sensor 116 is mounted to main frame 12 by a mounting rod 118 with rod 118 being itself welded to frame 12.

Mounted on the main drive shaft 26 exteriorly of brake 110 is a flywheel 120 on the periphery of which is removably mounted a mounting bracket 122. Mounting bracket 122 is comprised of a generally U-shaped member 124 and set screws 126 which hold the U-shaped member at a fixed position on flywheel 120. Attached to the U-shaped member 124 is a small piece of ferrous metal such as a steel pin 128. The proximity detector 116 is a variable reluctance type of sensor mounted about one eighth inch from pin 128 and is actuated each time pin 128 passes thereby so that it is possible to monitor the speed of drive shaft 26, as will be more fully described hereinafter.

Figure 3:
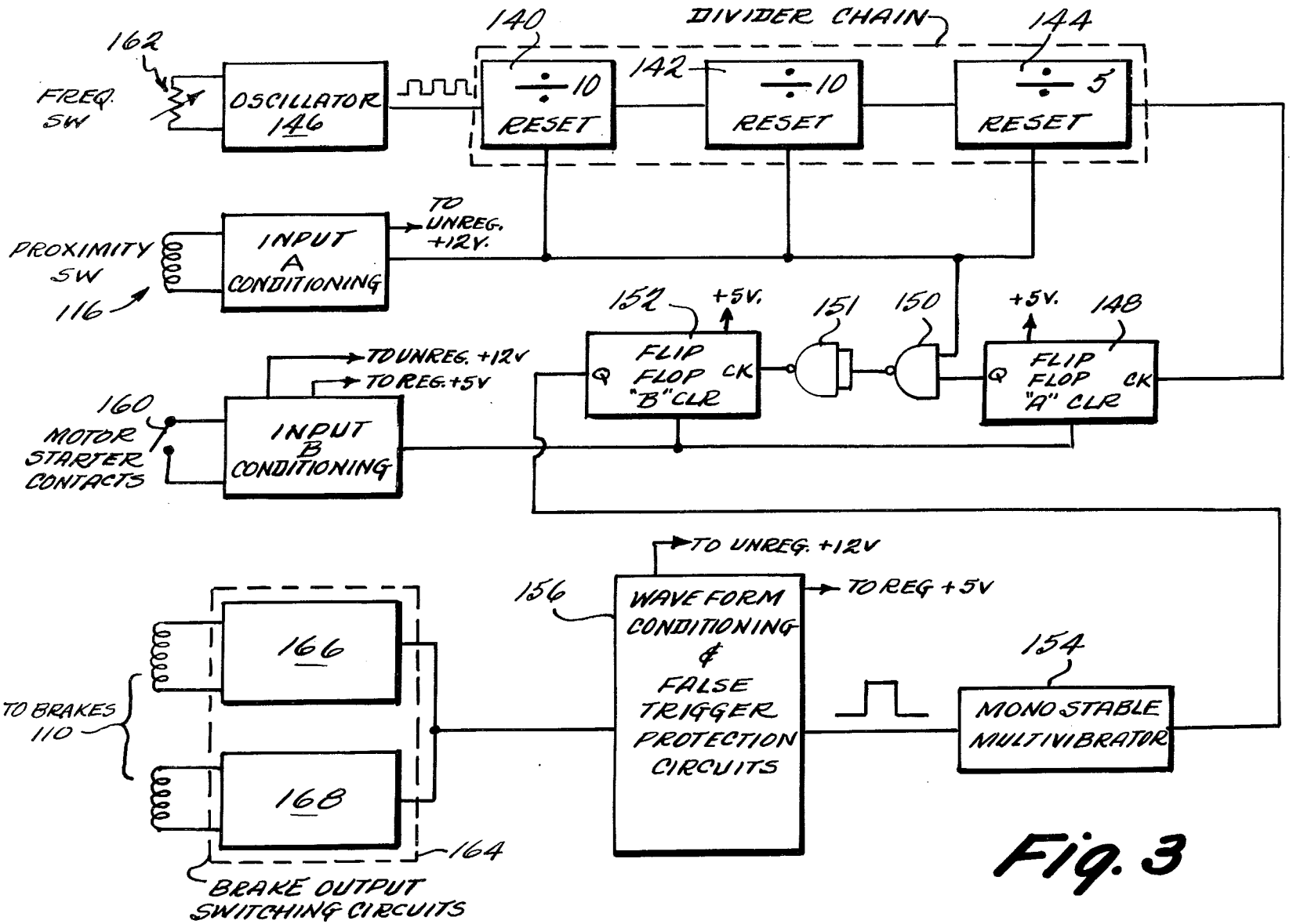
FIG. 3 is a diagrammatic view of that part of the control circuitry embodied within the present invention for controlling the stopping of the tufting machine.

Turning now to FIG. 3, the control circuit set forth therein is the circuit provided to control the stopping of the tufting machine and in particular the main drive shaft 26. This circuit also is provided for the purposes of monitoring the speed of the main drive shaft 26, the condition of the main drive motor 27 and the angular position of the main drive shaft 26. In response to sensing of the proper conditions as described more fully hereinafter, this circuit will apply power to electromagnetic brakes 110 in order to stop rotation of the main drive shaft 26 within a specified arc of rotation every time the tufting machine 10 is stopped. As indicated above there are three conditions being monitored: the revolutions or speed of main drive shaft 26, the angular position of the main drive shaft 26 as sensed by proximity switch 116 thereby producing Input A in FIG. 3 and the condition of drive motor 27, which supplies Input B in FIG. 3. Input A is provided by the proximity switch 116 which as mentioned is a reluctance actuated switch actuated each time pin 128 passes adjacent thereto. Input B is provided by the closing of motor starter contacts 160, which occurs when the power to the main drive motor 27 is turned off.

Input A from proximity switch 116 is connected to the indicated divider chain comprised of dividers 140, 142 and 144 which can be, for example a type of 7490 manufactured by Texas Instruments. Also connected to the divider chain is oscillator 146 such as a model type 8038 manufactured by Intersil whose frequency can be exteriorly adjusted by variable resistor 162. The circuit consisting of oscillator 146, the divider chain including dividers 140-144 in conjunction with the output signal provided by proximity switch 116, referred to hereinbefore as Input A in FIG. 3, will provide a rotation monitoring circuit for constantly monitoring the velocity of main drive shaft 26 based upon the time interval between output pulses from proximity switch 116. At a particular velocity, there will be a specific duration between pulses based on the time interval for pin 128 to pass proximity switch 116 with duration between pulses being dependent upon the rotation of drive shaft 26. It will be appreciated that oscillator 146 is set to produce a pulse train of a predetermined duration. Since dividers 140-144 are reset by every Input A pulse received from proximity switch 116, the output from oscillator 146 will be nullified and the divider chain will not produce an output signal as long as the duration between pulses from the proximity switch 116, Input A, is less than the preset duration of pulses from oscillator 146. However, when the main shaft velocity falls below a predetermined value, which we have preferably set at 100 rpm, the divider chain will provide an output pulse to flip-flop 148, type 7474, manufactured by Texas Instruments.

When the duration between pulses from proximity switch 116 becomes greater than the preset duration of pulses from oscillator 146 the divider chain will not be reset and accordingly will go into a high condition indicating that the pulses from proximity switch 116, Input A, is sufficiently long so that the rotation of main drive shaft 26 has deaccelerated at least to the predetermined minimum rpm value. The normal operating rotational speed for the main drive shaft 26 is about 600 rpm and as previously indicated the predetermined minimum condition we have chosen is when main drive shaft 26 has deaccelerated to about 100 rpm. However, it should be understood that other rpm values could be used depending upon such factors as the normal machine operating speeds and the type of brakes being used. Thus, the high condition from the divider chain will appear as one input to flip-flop 148.

Input B, provided by the closing of motor starter contacts 160, will also produce an input signal to flip-flop 148 and also to flip-flop 152. As indicated previously, motor starter contacts 160 will be opened when the main drive motor 27 is energized and in a running condition thereby preventing the application of brakes when the drive motor 27 is running. When power to the main drive motor 27 is turned off as for example when it is desired to stop the tufting machine, motor starter contacts 160 will close indicating power to motor 27 has been turned off. Input B is normally low or at a zero logic level and changes to a high or one logic level condition when contacts 160 are closed thus producing high or one logic level input to flip-flops 148 and 152.

After power to main drive motor 27 is turned off, the main drive shaft 26 will begin to deaccelerate. At this time, the change in the condition of motor contacts 160, Input B, will produce a high input to flip-flops 148 and 152. When the velocity of the main drive shaft 26 slows to about 100 rpm, an output signal will be generated, as explained hereinbefore, from the revolution monitoring circuit. This output from the divider chain will also appear as a high or logic level one input to flip-flop 148. Since flip-flops 148 and 152 are both provided with a regulated +5 volts supply, the two high inputs to flip-flop 148, from the divider chain and from Input B, will cause the Q output of flip-flop to 148 also go high or to a logic level one condition. This logic level one or high output from the flip-flop 148 serves as one input to NAND gate 150.

The other input for NAND gate 150 is connected to the proximity switch 116, Input A. Thus, NAND gate 150 will not produce an output signal or change from a high to a low condition until both inputs, from flip-flop 148 and Input A, are high at a logic level one condition. In other words, when drive shaft 26 has deaccelerated to about 100 rpm one input to NAND gate 150 will go high. However, the brakes should not be energized until the main drive shaft 26 is positioned at the proper angular position thereafter as sensed by proximity switch 116 during the next complete revolution.

In order to correctly and accurately stop the rotation of main drive shaft 26 we have found that it must be within a predetermined range of angular positions when the brakes are energized and this is assured by connecting the other input of NAND gate 150 to Input A. Therefore, with the divider chain having gone high so as to change the condition of flip-flop 148 the next output pulse or signal from proximity switch 116, Input A, will indicate main drive shaft 26 is at the proper angular position for the brakes to be applied prior to being stopped. On this next output pulse from proximity switch 116, Input A, the two inputs to NAND gate 150 will both be high so that the output from NAND gate 150 will become low a change to a zero logic level. The two inputs of NAND gate 151 are tied together so that the low output from NAND gate 150 serves as both inputs to NAND gate 151 and is inverted thereby so that a high or logic level one output condition is established for NAND gate 151.

NAND gates 150 and 151 are both 7400 series, NAND gates, produced, for example, by Texas Instruments. The high condition of NAND gate 151 provides a high or logic level one condition input to the clock input, Ck, of flip-flop 152. It will be recalled that Input B is already high or at a logic level one condition since motor starter contacts 160 are closed so that the appearance of the high input to flip-flop 152 causes the output of flip-flop 152 at Q to go high.

Thus, flip-flops 148 and 152 together with NAND gates 150 and 151 will not operate to produce an output from flip-flop 152 unless the motor starter contacts are closed, nor until the speed of the main drive shaft 26 has deaccelerated to a predetermined minimum level and the angular position is sensed as being correct for main drive shaft 26 and more specifically for the stopping thereof. As a practical matter, the sensed velocity of main drive shaft 26 must be at such a rate that brakes 110 can completely stop it in a relatively short amount of angular travel after brakes 110 are actuated.

The high output signal produced by flip-flop 152 will provide a high input to the monostable multivibrator 154 thereby triggering the multivibrator. The multivibrator 154 is preferably a model type 74121 as produced by Texas Instruments and, as indicated by the wave shown in FIG. 3, when triggered will generate a single pulse. This single pulse goes to the waveform conditioning and false trigger protection circuit, generally indicated at 156.

Only a single pulse having about a one second duration is required since the brakes 110 only need to be energized briefly in order to completely stop main drive shaft 26. Each time the multivibrator 154 produces an output pulse, assuming the main drive motor 21 is still off, brakes 110 will be energized and if pulses are continuously formed brakes 110 will remain energized. This is neither required nor even desirable since there may be instances when it will be necessary to be able to rotate the main drive shaft while the tufting machine is stopped. For example, it may be necessary to reposition the needle bar in order to perform certain repair work thereon or for that matter to index other machine mechanisms drivingly connected to or operated by the main drive shaft. Therefore, we have found that providing a single pulse from multivibrator 154 is sufficient to precisely stop drive shaft 26. Also, brake voltage must be applied for a short duration so that the tufting machine will be ready for restarting quickly.

The output from the waveform and false trigger protection circuits 156 will ultimately energize brake output switching circuits, generally indicated at 164.

As stated previously, the purpose of this entire stopping control circuit is to apply power to the electromagnetic brakes 110 so that the main drive shaft 26 lands or comes to rest within a specified arc of rotation every time the tufting machine is stopped. This brake output switching circuit 164 is comprised of two identical circuits, 166 and 168, which are hereinafter shown in detail in FIG. 6 and each serves to supply power to one of the electromagnetic brakes 110 at either end of main drive shaft 26.

Figure 4:
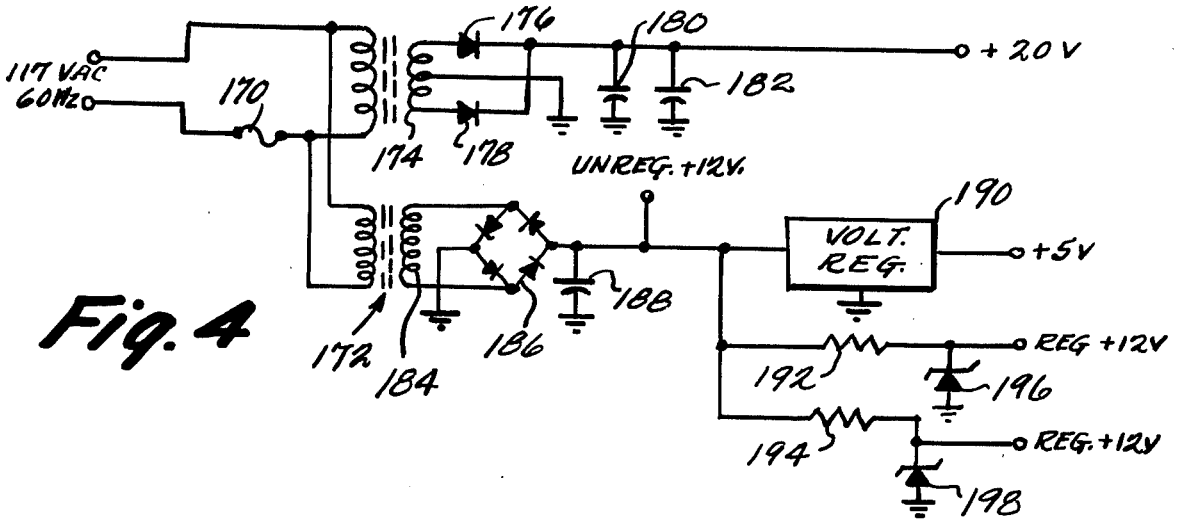
FIG. 4 is a schematic view of the power supply circuit for the control circuitry embodied within the present invention.

Turning now to FIG. 4, the power supply for the control circuits employed in this invention is set forth and, as shown, is connected to a 60 hertz 117 VAC source. A 5 amp fuse 170 is connected in the circuit leading from the power source for purposes of protecting the circuit and the transformer, generally indicated at 172. The secondary winding 174 on one side of the transformer 172 is connected to ground and serves to provide a +20 volt output through diodes 176 and 178 which are preferably type 1N1186A diodes. Also provided are two 18,000 microfarad capacitors 180 and 182 which are provided to assure the proper generation of that 20 volt output. The other side of transformer 172, provided by secondary winding 184, is connected to a diode bridge 186, the output of which is connected through a 2200 microfarad capacitor 188 and provides a direct source of unregulated +12 volts.

Also connected to secondary transformer winding 184 is a voltage regulator 190 such as a type 7805 manufactured by National Semiconductor. This voltage regulator 190 is internally preset so as to provide a power output of +5 volts as indicated in FIG. 4. In addition, two additional circuits are provided which serve to produce an output source of a regulated +12 volts. Each of these circuits consists of a 180 ohm resistor 192 and 194 and zener diode 196 and 198 respectively.

Figure 5:
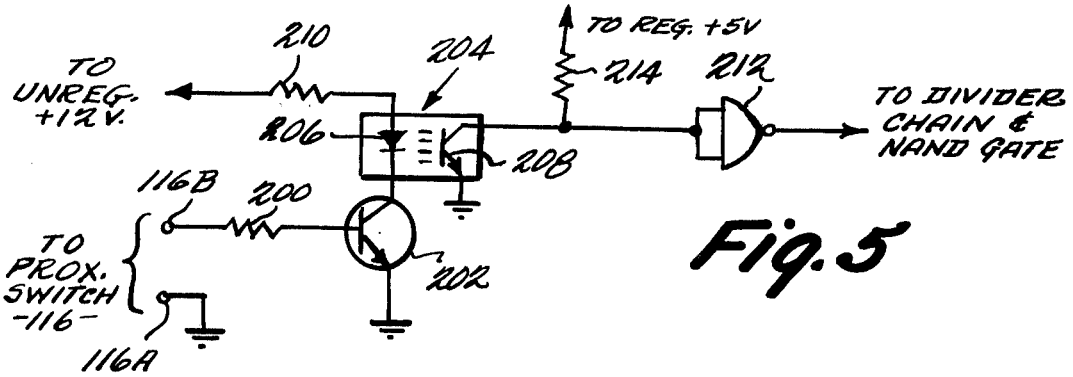
FIG. 5 is a more detailed schematic view of the circuitry producing Input B from the proximity switch provided to the circuit shown in FIG. 3.

Turning next to FIG. 5 the circuit details for Input B from the proximity switch 116 is set forth. This circuit can generally be referred to as the angular position monitoring circuit for main drive shaft 26 and will occasionally be so called. The proximity switch contacts, indicated at 116A and 116B, are shown with contact 116A connected to ground while contact 116B is connected through a 1.2 kilo ohm resistor 200 to the base of transistor 202 which is preferably a 2N2222A type transistor. The emitter of transistor 202 is connected to ground and while the collector is connected to an optoisolator 204 which is an Mct-2 optoisolator manufactured by Monsanto, a number of such optoisolators are used in the circuitry herein and each will be of this same type. As indicated, optoisolator 204 is constructed from a light emitting diode (LED) 206 and a light actuated phototransistor 208. The LED 206 is connected to the unregulated +12 volt power supply provided by the power supply circuit shown in FIG. 4 through a one kilo ohm resistor 210. The collector side transistor 208 is connected to both input leads of NAND gate 212 and also to the regulated +5 volt power supply through a 1.6 kilo ohm resistor 214. As indicated in FIG. 5, the output of NAND gate 212 is directed to the divider chain comprised of dividers 140, 142, and 144 and also to NAND gate 150.

Figure 6:
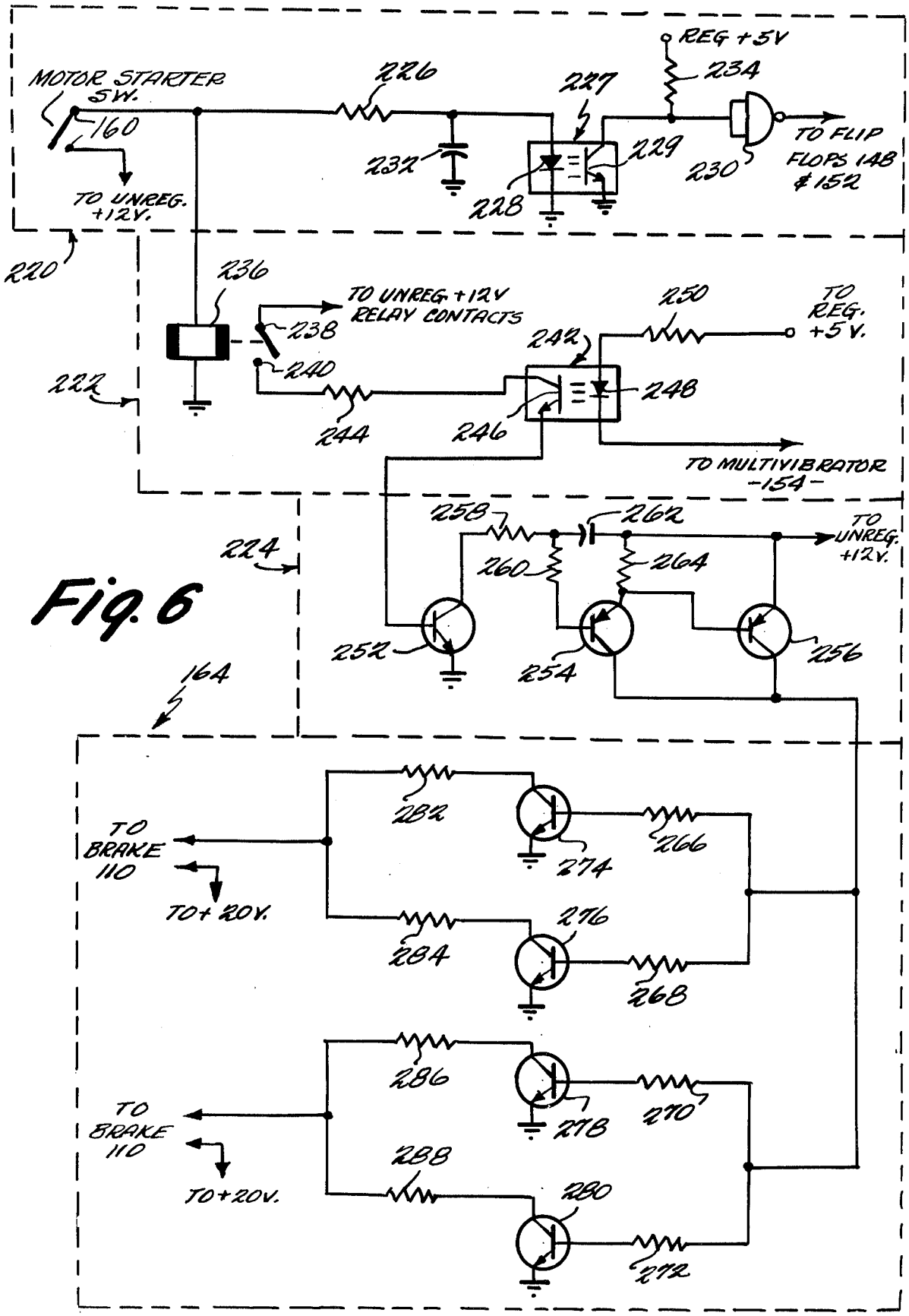
FIG. 6 is a more detailed schematic view of the Input A circuit, the false trigger protection circuit, the waveform and brake output switching circuits and their interconnection.

Turning now to FIG. 6, four separate circuits are shown and correspond to the circuits shown in FIG. 3 as follows: the Input B conditioning circuit from motor starter contacts 160 is indicated in FIG. 6 within dotted box indicated generally by the numeral 220; the false trigger protection circuit is indicated in the dotted box indicated generally by the numeral 222; the waveform conditioning circuit is indicated within the dotted box generally indicated by the numeral 224; while the brake output switching circuits are also generally indicated here at 164.

Turning first to the Input B conditioning circuit 220, one side of the motor starter contacts 160 are connected to the unregulated +12 power supply, while the other side of contacts 160 are connected to flip-flops 148 and 152 through a one kilo ohm resistor 226, optoisolator 227 and NAND gate 230, both the inputs of which are connected to the output of optoisolator 227. In addition, a capacitor 232 is provided between the motor starter contacts 160 and the optoisolator 227 for purposes of supressing noise and is preferably a 100 microfarad capacitor. In addition, the NAND gate 230 is connected to the regulated +5 volt power supply through a 1.6 kilo ohm resistor 234. Optoisolator 227 is comprised of an LED 228 and a light actuated phototransistor 229. The LED is connected to the RC circuit comprised of resistor 226 and capacitor 232 and ground so that it will render the phototransistor 229 conductive when motor starter contacts 160 are closed. The emitter of phototransistor 229 is connected to ground while its collector is connected to both inputs of NAND gate 230. Thus, the emitter-collector path will provide an output to NAND gate when motor starter contacts 160 are closed and the main drive motor 27 is deenergized.

Also connected to the motor starter circuit is the false trigger protection circuit indicated in FIG. 6 at 222. The false trigger protection circuit is comprised of an actuating relay 236 which serves to close relay contacts 238 and 240 when the motor starter contacts 160 are closed. Relay contact 238 is connected to the unregulated +12 volt power supply whereas relay contact 240 is connected to another optoisolator 242 through a 680 ohm resistor 244. Specifically, contact 240 is connected to the collector of phototransistor 246 within optoisolator 242. As was true with optoisolators 204 and 227, the base of phototransistor 246 is actuated by LED 248 while the emitter of phototransistor 246 is connected to the base of transistor 252 and provides a collector-emitter path from the unregulated +12 volt power supply to one side of the waveform circuit 224.

LED 248 is connected to the regulated +5 volt power supply by means of a 1.6 kilo ohm resistor 250 and is rendered conductive by means of the pulse generated by the monostable multivibrator 154 in response to the outputs from flip-flops 148 and 152 discussed previously hereinbefore.

Therefore, reviewing this portion of the circuit shown in FIG. 6, when the motor starter switch 160 is closed, the unregulated +12 volt power supply will be connected to the Input B circuit shown generally indicated at 220. This causes optoisolator 228 to become conductive and causes NAND gate 230 to change state thus producing a high or a logic one condition to be applied in the form of Input B to flip-flops 148 and 152. Likewise, relay 236 is energized so that contacts 236 and 240 are connected together. This connects optoisolator 242 to the unregulated +12 volt power supply so that the phototransistor 246 is placed essentially in a ready condition should a pulse from multivibrator 154 actuate LED 248 and render the optoisolator 242 conductive.

As generally indicated at 224, the waveform circuit is comprised of three transistors 252, 254 and 256 respectively. Transistor 252 is preferably a type 40348 transistor, transistor 254 is preferably a 2N2905 transistor whereas transistor 256 is preferably a T1P42C type transistor. The base of transistor 252 is connected to the emitter of phototransistor 246 in optoisolator 242 so that when phototransistor 246 is rendered conductive by a pulse applied to LED 248, phototransistor 246 through its collector-emitter path connects the base of transistor 252 to the unregulated +12 volt power supply but only if motor starter contacts 160 are closed and main drive motor 27 deenergized. The emitter of transistor 252 is connected to ground and the collector is connected to a 27 ohm resistor 258. An RC circuit is comprised of resistor 260, preferably a 3.9 kilo ohm resistor and capacitor 262, which is a 47 microfarad capacitor. The base of transistor 254 is connected to this RC circuit, specifically resistor 260, whereas the emitter of transistor 254 is connected thereto and specifically to capacitor 262 through a one kilo ohm resistor 264. The base of transistor 256 is connected between the emitter of transistor 254 and resistor 264 and its emitter is connected to the unregulated +12 volt power supply and its collector is connected to the brake output switching circuits generally indicated in FIG. 6 at 164. Thus, when transistors 254 and 256 are rendered conductive, their conducting collector-emitter path serves to connect the brake output switching circuits to the unregulated +12 volt power supply.

The purpose of the waveform circuit generally indicated at 224 and the RC circuit therein is really to lengthen the fall time of the single pulse from multivibrator 154 so that the pulse from multivibrator 154 does not decay instantaneously. Also, the RC circuit provided by resistor 260 and capacitor 262 effectively add about one half of a second to the pulse duration. Therefore, this waveform circuit essentially modifies the pulse coming from the multivibrator 154 so that it has an exponentially decaying trailing edge. Likewise, the circuit is necessary to protect the output switching circuits for the brakes from any high voltage transients which might be caused by decreased in the current in the brake coils occurring too quickly.

Turning next to the brake output switching circuits 164, two identical circuits are provided therein and each serves to connect one of the brakes 110, positioned on either end of the main drive shaft 26, to the +20 volt power supply. As indicated above, collectors of transistors 254 and 256 are both connected to each braking circuit. Each brake circuit is comprised of two 15 ohm resistors, 266, 268, 270 and 272 respectively connected to the bases of transistors 274, 176, 278 and 280 which are all preferably type 2N3055 transistors. The emitter of transistor 274 is connected to ground whereas the collector is connected to a 0.05 ohm resistor 282. In a similar fashion the collectors of transistors 276, 278, and 280 are also respectively connected to 0.05 ohm resistors 284, 286 and 288 respectively whereas their emitters are also likewise connected to ground. When transistors 254 and 256 are rendered conductive, the pulse coming to the bases of transistors 274, 276, 278 and 280 through resistors 266–272 respectively immediately render transistors 274–280 conductive causing the energization of brakes 110 and connects them to the +20 volt power supply. Since only one pulse is received from multivibrator 154 the optoisolator 242 is only momentarily conductive and while the waveform is modified by the waveform circuit generally indicated at 224, the total pulse duration time is approximately only a second and a half which we have found is sufficient to precisely stop further rotation of the main drive shaft 26.

Figure 7:
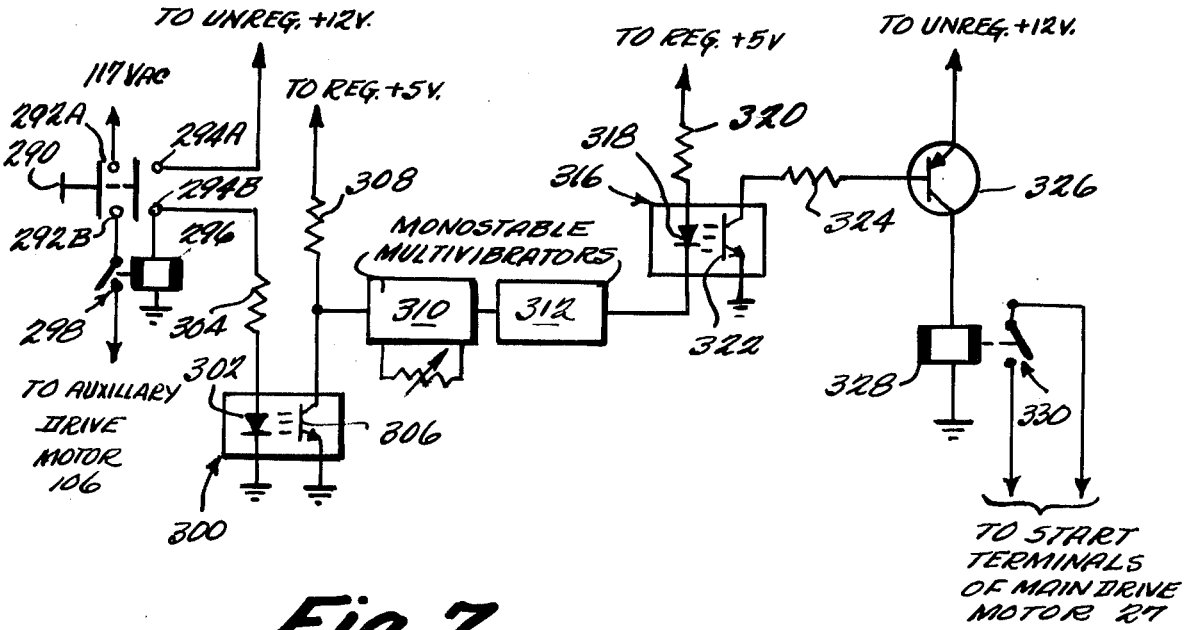
FIG. 7 is a schematic view of the motor starter and time delay circuits for starting the main and auxiliary drive motors.

Turning now to FIG. 7, the starting control circuit is set forth. This circuit provides an immediate energization of the auxiliary drive motor 106 but delays the restarting of the main drive motor 27 for a predetermined time period during which the auxiliary yarn feed drive motor 106 is operating to bring the yarn feed system into a direct drive relationship with main drive shaft 26. A push button indicated at 290 is connected to two sets of isolated contacts 292 and 294 with the respective contacts indicated at 292A, 292B and 294A, 294B, respectively. Contact 294A is connected to the 117 VAC power supply whereas contact 292B is connected to auxiliary drive motor 106 through relay contacts, generally indicated at 298, controlled by relay 296. Contact 294A is connected to the unregulated +12 volt power supply whereas contact 294B is connected to relay 298 the other side of which is connected to ground as shown in FIG. 7. When push button 290 is preferably a momentary push button, and when depressed, circuits are simultaneously completed through contact sets 292 and 294 which connects relay 296 to its power supply of +12 volts thereby closing contacts 298 connecting the auxiliary drive motor 106 to the 117 VAC power supply. At the same time, optoisolator 300 is energized since LED 302 is also connected to the unregulated +12 volt power supply through a one kilo ohm resistor 304. When the LED 302 becomes conductive it places the phototransistor 306 in the optoisolator 300 in a conductive mode and as shown the emitter of phototransistor 306 is connected to ground whereas a collector is connected to the regulated +5 volt power supply through a 1.6 kilo ohm resistor 308. A purpose of optoisolator 300 is essentially to cut out any possible noise problems resulting from the closing of push button contacts 292 and 294 so that the start circuit is more regulated. The conduction of phototransistor 306 provides an input signal to the monostable multivibrators 310 and 312 and as shown, the use of a variable resistor 314 exteriorly of multivibrator 312 provides means by which the multivibrators are essentially programmable to provide the desired amount of time delay for the starting of main drive motor 27. The output of multivibrators 310 and 312 passes to an optoisolator 316 comprised of an LED 318 and a phototransistor 322. The LED 318 is connected to the regulated +5 volt power supply through a 390 ohm resistor 320 while the emitter of phototransistor 322 is connected to ground and the collector is connected to the base of transistor 326 through a 1.6 kilo ohm resistor 324. Therefore, the output of optoisolator 316 is applied to the base of 326 after the running of the time delay programmed into the multivibrators 310 and 312 causing the transistor 326 to become conductive. The emitter of transistor 326 is connected to the unregulated +12 volt power supply and the emitter-collector conductive path serves to energize relay 328 which in turn will close its relay contacts, generally indicated at 330, so as to complete the start circuit to the start terminals of the main drive motor 27.

Thus, in operation, when the machine is to be started, push button start switch 290 is actuated thereby actuating the auxiliary drive motor 106 and the time delay circuit which prohibits starting of the main drive motor 27 for a predetermined time.

As indicated previously, the yarn feed auxiliary drive motor 106 is immediately energized and causes a slight but predetermined amount of angular movement of feed yarn drive shaft 86. This in turn causes a slight rotation of the yarn feed drive element including the gears within gear box 84 and also a slight rotation of the yarn feed roller 66 together with feed rollers 62, 64 and 68 which are drivingly connected therewith. Because of the presence of overrunning clutch 89, this action causes a relative motion within all of the components of the yarn feed system 60 with respect to the main drive shaft 26 thereby removing all loose motion in the yarn feeding system. Through the action of auxiliary motor 106 the drive system for the yarn feed system is placed in a tight or effectively a direct drive relationship with main drive shaft 26 so that full yarn feed will be synchronized with the actual start-up of the main drive motor 27 and the main drive shaft 26 as produced by the fluid clutch 27*a*. Thereafter, when the main drive shaft 26 begins to rotate, motion is immediately and simultaneously transmitted to the yarn feed rollers 62–68, needle bar 28 and looper drive shaft 36.

Since rotation of the yarn feed rollers 62–68 can now begin at the same time the other parts of the tufting machine which are in a direct drive relationship with the main drive shaft begin moving, yarn feed will occur at a rate which assures sufficient quantities of yarn are immediately available corresponding to the need therefor. As a further aid, the fluid clutch 27*a* provides a gradual start-up for the main drive shaft. Thus, the combination of these measures assures that those first rows of tufted loops will be produced with proper amounts of yarn fed at a rate comparable to actual machine speed without the production of a stop mark.

Upon completion of this prestart cycle and the running of the time delay provided by the time delay circuit, the main drive motor 27 is started causing a gradual start-up of rotation of the main shaft 26 through fluid clutch 27*a*. The yarn feed drive shaft 86 will now be driven by means of drive belt 90 and pulleys 88 and 92 together with overrunning clutch 89. At the same time, the oppositely mounted overrunning clutch 98 in the auxiliary feed drive system previously operated by auxiliary yarn drive motor 106 will be overrunning with respect to the auxiliary yarn drive motor 106 thus allowing the auxiliary drive motor 106 to remain stationary until it is needed in the next start cycle. In addition, the fluid clutch 27*a* provided with main drive motor 27 will assure a relatively slow and smooth start of the entire tufting machine operation thereby helping to assure that the initial movement of needle bar 28, looper drive shaft 36 and the yarn feed system 60 is begun in a synchronous, in-phase fashion.

The amount of rotation of the yarn feed drive shaft 86 as provided by the auxiliary yarn feed drive motor 106 is critical. If the yarn feed drive shaft 86 is rotated to too great an extent, yarn feed rollers 62–68 will essentially have been overfed thereby producing a row of high loops. Conversely, too little rotation of the yarn feed drive shaft 86 will not cause yarn feed rollers 62–68 to be fed enough which may cause a low row with either the high or low row being objectionable. Therefore, the motor 106 is provided with an external rheostat to control the amount of angular movement of shaft 86. We have found that once auxiliary motor 106 is set such setting does not need to be altered, notwithstanding changes in yarns and carpet constructions being tufted. However, it should be understood that as gearing in the yarn feed system becomes worn, some slight additional amounts of additional correction in such setting may be required.

As an aid in correctly correlating the amount of initial rotation for the yarn feed drive shaft 86 we discovered that it is important to begin each start cycle within a predetermined range of angular positions for the main drive shaft 26 and thus likewise for the yarn feed drive shaft 86. Without any controls, when the tufting machine main drive shaft is allowed to coast to a stop or brakes are applied in an uncontrolled fashion the stopping point of the main drive shaft will be random so that the machine will not stop at one angular position time and time again. Thus, subsequent start-ups from such different angular positions would require differing amounts of and rates of movement of the needles and looper hooks for a given angular displacement of the main drive shaft depending upon the changing angular displacement of the main drive shaft. Therefore, we determined that the main drive shaft should be stopped each time at substantially the same angular position at or just past its top dead center position, so that subsequent restarting can be made more uniform.

We have found that preferably the main drive shaft should be stopped within the range of about 20 degrees in relation to its top dead center position. It should be noted, that the top dead center position corresponds to that position where the needle bar 28 is in its most fully raised condition. Further, this 20 degrees range will be split so that the range includes a rotational arc area of about 10 degrees before and after the exact top dead center position. While power is applied to the brakes for about one second to about one and one half seconds, the main drive shaft can be brought to a stop within about one half to one seconds. However, the actual time, of course, is dependent upon the type of machine and the brakes used. We have found that the main drive shaft will travel for about 30 to about 40 degrees after the brakes 110 have been energized and, therefore, we have determined that the pin 128 on flywheel 120 will need to be positioned about 30 to about 40 degrees ahead of the top dead center angular position in order to consistently stop the main drive shaft within the preferred range of about 10 degrees on either side of the top dead center position.

As explained above, brakes 110 are provided on each end of the main drive shaft 26 and in response to the control circuit shown in FIGS. 3–6 stop the main drive shaft 26 within a predetermined range of angular positions each time the tufting machine is stopped. When the main drive motor 27 is deenergized, the speed of the main drive shaft 26 begins to lessen. At a predetermined velocity as sensed by the proximity detector 116, the application of brakes 110 will allow the machine to be brought to an abrupt stop and at the correct angular position.

Further, we discovered that more accurate stops can be effected if brakes 110 are initially overexcited by applying a voltage much higher than that at which such brakes are normally rated. We have found that shaft 26 normally operates at 600–800 rpm and that when shaft 26 slows to a velocity of about 100 rpm, brakes 110, when actuated, will stop shaft 26 precisely within the predefined and predetermined angular positioning limits. The Warner brakes referred to above have a nominal rating of 6 volts and it has been found that by applying excess voltage, such as 20 volts, thereby overexciting the brakes, extremely rapid and accurate stops can be produced.

It will now be clear that there is provided a device which accomplishes the objectives heretofore set forth regarding the production of tufted carpets and the substantial elimination of normal stop mark problems. While the invention has been disclosed in a preferred form, it is to be understood that the specific embodiment described and illustrated herein is not to be considered in a limited sense as there may be other forms or modifications of the present invention which should also be construed to come within the scope of the appended claims.

What we claim is:

1. In a tufting machine for forming pile fabric having a frame, a main drive shaft, a plurality of tufting needles mounted in a reciprocating needle bar assembly operatively connected to said main drive shaft so as to be movable between raised and lowered conditions, a looper assembly comprised of a plurality of loopers operatively associated with the plurality of needles, a looper assembly drive shaft operatively associated with said main drive shaft, means for feeding backing material through the machine past the needle bar and looper assemblies, a yarn feed system operatively connected to said main drive shaft for feeding yarns to said plurality of needles and drive means for driving said main drive shaft so as to feed yarn and successively form rows of tufted loops from the yarns the improvement comprising control means for controlling the stopping and starting of the tufting machine, clutch means operatively connected to said drive means for providing a gradual engagement between said drive means and said main drive shaft upon starting of the tufting machine, brake means operatively connected to said main drive shaft for stopping said main drive shaft at a predetermined angular position in response to said control means and synchronizing means for synchronizing the starting operation of the main drive shaft and the yarn feed system.

2. A tufting machine as in claim 1 wherein said control means comprises a power supply, stopping and starting circuit means for respectively controlling the stopping and starting of said tufting machine.

3. A tufting machine as in claim 1 wherein said brake circuit means includes brake output switching circuit means for energizing said brake means in response to the output signal from said sequence discriminator circuit means said brake output switching circuit means being connected to said sequence discriminator circuit means through waveform circuit means for increasing the duration of the output signal coming from said sequence discriminator circuit means and for protecting said brake output switching circuit means.

4. A tufting machine as in claim 1 wherein said stopping circuit means further includes false trigger protection circuit means for assuring that said brake means cannot be energized while said drive means remains energized.

5. A tufting machine as in claim 4 wherein said false trigger protection circuit means is connected between said sequence discriminator circuit means and said brake circuit means.

6. A tufting machine as in claim 1 wherein said starting switch means comprises a momentary switch the closing of which simultaneously energizes said first starting circuit means and the time delay provided by said second starting circuit means.

7. A tufting machine as in claim 1 wherein said predetermined time delay preferably ranges from about 1 to about 4 seconds.

8. A tufting machine as in claim 1 wherein said rotation monitoring circuit means produces an output signal when said predetermined minimum speed is about 100 rpm.

9. A tufting machine as in claim 1 wherein said clutch means includes a fluid clutch.

10. A tufting machine as in claim 1 wherein said yarn feed system includes a yarn feed drive shaft operatively connected to said main drive shaft through a first overrunning clutch mounted to said yarn feed drive shaft, said auxiliary drive means includes an auxiliary drive motor operatively connected to said yarn feed drive shaft through a second overrunning clutch mounted to said yarn feed drive shaft oppositely from said first overrunning clutch.

11. A tufting machine as in claim 10 wherein said auxiliary drive motor comprises a stepping motor providing a predetermined amount of angular rotation for said yarn feed drive shaft thereby causing the initial feeding of a predetermined length of yarn and removing any looseness within the yarn feed system.

12. An improved method of eliminating stop marks during the tufting of carpets by controlling the stopping and starting of a tufting machine in which the tufting machine yarn feed system is drivingly connected to the main drive shaft of the tufting machine the method comprising the steps of:

stopping the main drive shaft of the tufting machine at an angular position within a predetermined range of angular positions;

upon restarting the tufting operation delaying the energization of the tufting machine main drive motor for a predetermined period while simultaneously driving the tufting machine yarn feed system so as to bring the yarn feed drive mechanism into a substantially direct drive relationship with the main drive shaft; and at the termination of the predetermined delay period energizing the main drive motor and causing the main drive motor to bring the main drive shaft up to normal operating speed in a smooth, gradual manner.

13. The method as in claim 12 wherein the step of stopping the main drive shaft includes the additional steps of:

producing a first electrical signal in response to deenergizing the main drive motor;

monitoring the rotational velocity of the main drive shaft and producing a second electrical signal when the rotational velocity of the main drive shaft falls below a predetermined minimum;

monitoring the angular position of the main drive shaft and producing a third electrical signal each time the main drive shaft passes a predetermined angular position;

transmitting the first, second and third electrical signals to control circuitry controlling the operation of brakes operatively associated with the main drive shaft and actuating such brakes in response to receiving the first, second and third electrical signals.

14. In a tufting machine for forming pile fabric having a frame, a main drive shaft, a plurality of tufting needles mounted in a reciprocating needle bar assembly operatively connected to said main drive shaft so as to be movable between raised and lowered conditions, a looper assembly comprised of a plurality of loopers operatively associated with the plurality of needles, a looper assembly drive shaft operatively associated with said main drive shaft, means for feeding backing material through the machine past the needle bar and looper assemblies, a yarn feed system operatively connected to said main drive shaft for feeding yarns to said plurality of needles and drive means for driving said main drive shaft so as to feed yarn and successively form rows of tufted loops from the yarns the improvement comprising control means for controlling the stopping and starting of the tufting machine, clutch means operatively connected to said drive means for providing a gradual engagement between said drive means and said main drive shaft upon starting of the tufting machine, brake means operatively connected to said main drive shaft for stopping said main drive shaft at a predetermined angular position in response to said control means and synchronizing means for synchronizing the starting operation of the main drive shaft and the yarn feed system wherein said control means comprises a power supply, stopping and starting circuit means for respectively controlling the stopping and starting of said tufting machine, said stopping circuit means for controlling the stopping of said tufting machine including first stopping circuit means for monitoring the rotation of said main drive shaft and for producing an output signal when the rotation thereof falls below a predetermined minimum speed; second stopping circuit means for monitoring the angular position of said main drive shaft and for producing an output signal each time said main drive shaft passes a predetermined angular position; third stopping circuit means for sensing the operating condition of the tufting machine drive means and for producing an output signal when said drive means is deenergized; sequence discriminator circuit means connected to said first, second and third stopping circuit means for receiving the output signals from said first, second and third circuit means and for producing an output signal in response to receiving the output signal from said first and third circuit means followed by the output signal from said second circuit means; brake circuit means connected to said sequence discriminator circuit means for receiving the output signal therefrom and for energizing said brake means in response thereto.

15. In a tufting machine for forming pile fabric having a frame, a main drive shaft, a plurality of tufting needles mounted in a reciprocating needle bar assembly operatively connected to said main drive shaft so as to be movable between raised and lowered conditions, a looper assembly comprised of a plurality of loopers operatively associated with the plurality of needles, a looper assembly drive shaft operatively associated with said main drive shaft, means for feeding backing material through the machine past the needle bar and looper assemblies, a yarn feed system operatively connected to said main drive shaft for feeding yarns to said plurality of needles and drive means for driving said main drive shaft so as to feed yarn and successively form rows of tufted loops from the yarns the improvement comprising control means for controlling the stopping and starting of the tufting machine, clutch means operatively connected to said drive means for providing a gradual engagement between said drive means and said main drive shaft upon starting of the tufting machine, brake means operatively connected to said main drive shaft for stopping said main drive shaft at a predetermined angular position in response to said control means and synchronizing means for synchronizing the starting operation of the main drive shaft and the yarn feed system wherein said control means comprises a power supply, stopping and starting circuit means for respectively controlling the stopping and starting of said tufting machine, said starting circuit means including starting switch means for initiating the starting sequence; first starting circuit means connected to said starting switch means for actuating said synchronizing means; and second starting circuit means connected to said starting switch means for energizing said drive means after a predetermined time delay.

16. In a tufting machine for forming pile fabric having a frame, a main drive shaft, a plurality of tufting needles mounted in a reciprocating needle bar assembly operatively connected to said main drive shaft so as to be movable between raised and lowered conditions, a looper assembly comprised of a plurality of loopers operatively associated with the plurality of needles, a looper assembly drive shaft operatively associated with said main drive shaft, means for feeding backing material through the machine past the needle bar and looper assemblies, a yarn feed system operatively connected to said main drive shaft for feeding yarns to said plurality of needles and drive means for driving said main drive shaft so as to feed yarn and successively form rows of tufted loops from the yarns the improvement comprising control means for controlling the stopping and starting of the tufting machine, clutch means operatively connected to said drive means for providing a gradual engagement between said drive means and said main drive shaft upon starting of the tufting machine, brake means operatively connected to said main drive shaft for stopping said main drive shaft at a predetermined angular position in response to said control means and synchronizing means for synchronizing the starting operation of the main drive shaft and the yarn feed system wherein said control means comprises a power supply, stopping and starting circuit means for respectively controlling the stopping and starting of said tufting machine, said synchronizing means including an auxiliary drive means for driving said yarn feed system independently of said drive means, said starting circuit means including starting switch means for starting the tufting machine and simultaneously energizing a first starting circuit means for energizing said auxiliary drive means and a second starting circuit means for energizing said drive means after a predetermined time delay whereby said auxiliary drive means operates during the time delay provided by said second starting circuit means to feed an initial predetermined amount of yarn.

* * * * *